US006016137A

United States Patent [19]

Evans et al.

[11] Patent Number: 6,016,137

[45] Date of Patent: Jan. 18, 2000

[54] METHOD AND APPARATUS FOR PRODUCING A SEMI-TRANSPARENT CURSOR ON A DATA PROCESSING DISPLAY

[75] Inventors: Edward Kelley Evans, Essex Junction; Andrew Anthony Long, Winooski; Roderick Michael Peters West, Colchester, all of Vt.

[73] Assignee: International Business Machines Corporation, Armonk, N.Y.

[21] Appl. No.: 08/380,762

[22] Filed: Jan. 30, 1995

[51] Int. Cl.[7] ..... G09G 5/08

[52] U.S. Cl. ..... 345/145; 345/113; 345/114; 345/435

[58] Field of Search ..... 345/113, 114, 345/115, 116, 435, 145, 157

[56] References Cited

U.S. PATENT DOCUMENTS

| | | | |
|---|---|---|---|
| 4,675,725 | 6/1987 | Parkyn | 348/584 |
| 4,694,286 | 9/1987 | Bergstedt | 345/153 |
| 4,704,605 | 11/1987 | Edelson | 345/153 |
| 4,977,398 | 12/1990 | Pleva et al. | 345/147 |
| 5,025,249 | 6/1991 | Seiler et al. | 345/340 |
| 5,060,171 | 10/1991 | Steir et al. | 345/435 |
| 5,124,688 | 6/1992 | Rumball | 345/154 |
| 5,129,060 | 7/1992 | Pfeiffer et al. | 395/166 |
| 5,146,592 | 9/1992 | Pfeiffer et al. | 395/157 |
| 5,150,457 | 9/1992 | Behm et al. | 395/120 |
| 5,162,779 | 11/1992 | Lumelsky et al. | 345/145 |
| 5,181,100 | 1/1993 | Hodgson | 358/37 |
| 5,185,597 | 2/1993 | Pappas et al. | 345/145 |
| 5,218,457 | 6/1993 | Burkhardt et al. | 358/448 |
| 5,227,863 | 7/1993 | Bilbrey et al. | 358/22 |
| 5,243,332 | 9/1993 | Jacobson | 345/44 |
| 5,250,933 | 10/1993 | Beaudin et al. | 345/115 |
| 5,251,298 | 10/1993 | Nally | 395/166 |
| 5,264,837 | 11/1993 | Buehler | 345/115 |
| 5,270,688 | 12/1993 | Dawson et al. | 345/145 |
| 5,287,096 | 2/1994 | Thompson et al. | 345/147 |
| 5,291,187 | 3/1994 | Wood et al. | 345/185 |
| 5,332,968 | 7/1994 | Brown | 324/309 |
| 5,361,081 | 11/1994 | Barnaby | 345/145 |
| 5,367,318 | 11/1994 | Beaudin et al. | 345/201 |
| 5,509,663 | 4/1996 | Otake et al. | 345/153 |
| 5,625,374 | 4/1997 | Turkowski | 345/113 |
| 5,815,137 | 9/1998 | Weatherford et al. | 345/162 |

FOREIGN PATENT DOCUMENTS 59-121590 7/1984 Japan .

OTHER PUBLICATIONS

A. S. Murphy, IBM Technical Disclosure Bulletin, vol. 26, No. 2, Jul. 1983, pp. 477–478, "Smooth Updating of Images on CRT Display".

R. X. Arroyo, et al., IBM Technical Disclosure Bulletin, vol. 36, No. 10, Oct. 1993, pp. 307–309, "Programmable Hot Spot for Sprite Bitmap Display".

R. X. Arroyo, et al., IBM Technical Disclosure Bulletin, vol. 36, No. 10, Oct. 1993, pp. 463–465, "64×62×2 Hardware Sprite Overlayed on VRAM Serial Data".

*Primary Examiner*—Bipin H. Shalwala
*Assistant Examiner*—Kent Chang
*Attorney, Agent, or Firm*—Dale M. Crockatt; Daryl K. Neff

[57] ABSTRACT

A method and apparatus which produces a semitransparent cursor for a video display presenting simultaneous viewing access to both the cursor and the underlying image information. At the on-screen location of the cursor, the viewer is able to simultaneously view and distinguish between the cursor and the underlying graphical data. In one form, the method includes the steps of obtaining the red, green, and blue video pixel data for each pixel representing at least a portion of the cursor; halving the numerical value of each datum of red, green, and blue video pixel data; injecting a binary value into the most significant bit of each datum to obtain modified red, green, and blue video pixel data; and providing modified red, green, and blue video pixel data to a video display.

7 Claims, 1 Drawing Sheet

FIGURE - Semi-Translucent Sprite/Cursor Circuitry
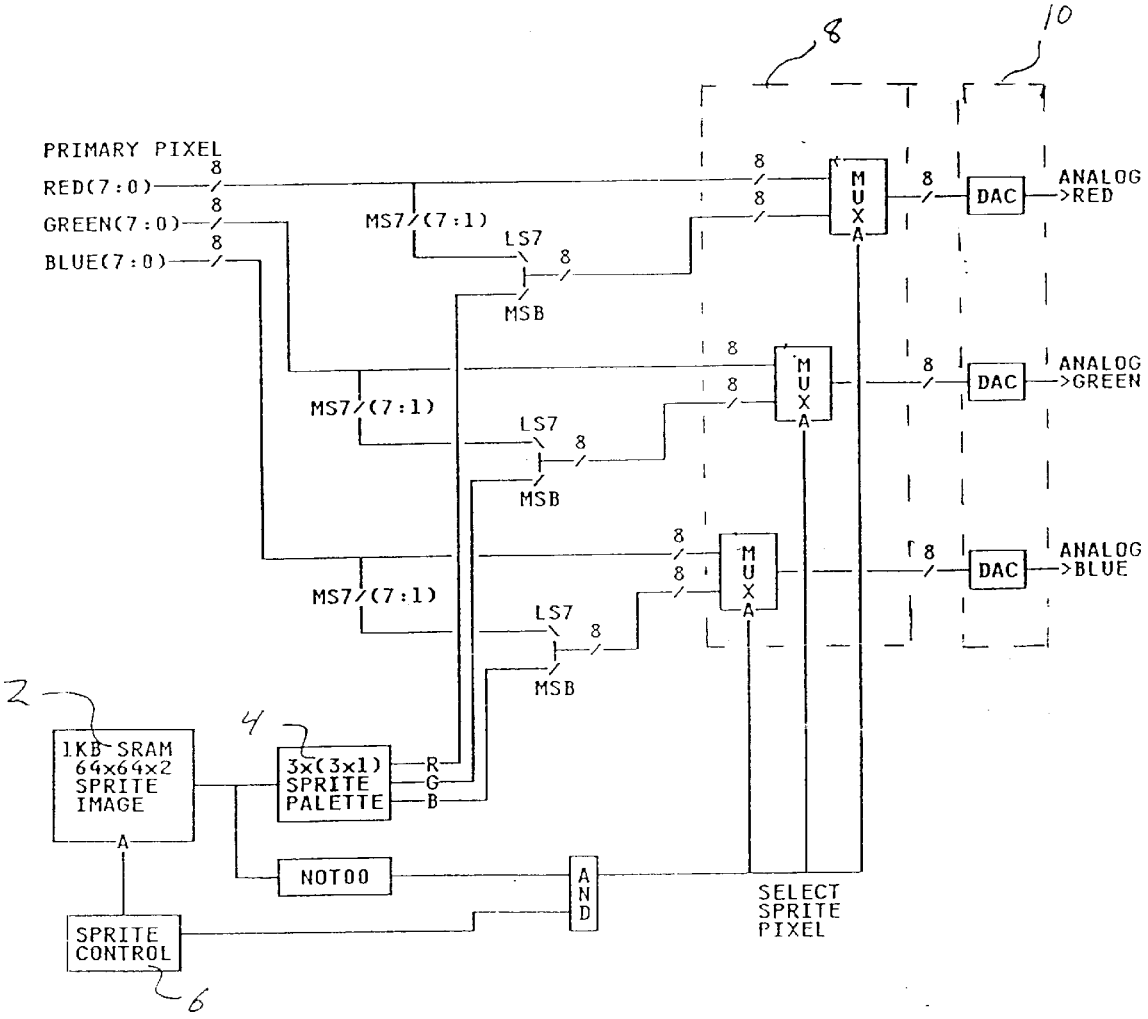

METHOD AND APPARATUS FOR PRODUCING A SEMI-TRANSPARENT CURSOR ON A DATA PROCESSING DISPLAY

BACKGROUND OF THE INVENTION

1. Field of the Invention

The present invention generally relates to video processing in a computer system, and more particularly, to a method and apparatus for producing a semi-transparent cursor image on a video display.

2. Discussion of the Related Art

A "sprite" or "cursor" is a well known visual device used in the field of computer graphics and video and data processing displays. The terms "sprite" and "cursor" are used interchangeably in the art and also herein. A cursor is used as a visual pointing device to select or pick items and options from amongst those displayed on the computer screen. In addition, the cursor may be used as the on-screen visual representation of the current point of an active drawing operation. In most cases, the cursor is in the shape of an arrow or pointing finger formed of solid colors that overlay and obscure the underlying display image.

In advanced palette DACs such as are known in the art, it is usual to find circuitry implementing a hardware cursor. Typical known circuitry consists of an on-board static RAM (SRAM), control logic, a small cursor color palette, and multiplexor means for selecting either a cursor color or the primary pixel color. The SRAM is used to store the pixel data that defines the shape of the cursor. Typically, the SRAM has a size of 1 K Byte, defining the cursor shape in a square field 64 pixels wide by 64 lines high using 2 bits for each cursor pixel. The 2 bits per pixel allows the definition of 4 different types of cursor pixel. Usually the 00 value is used to define a transparent cursor pixel. A transparent cursor pixel is a non-displayed pixel within the cursor field that allows the background primary pixel color to be displayed at that position on the display screen and within the cursor field. The other three values (01,10,11) are generally used to define the selection amongst three different colors stored in the cursor color palette. At locations within the cursor field with these values, the color selected from the cursor color palette is displayed in place of the primary pixel color at that position on the display screen and within the cursor field. The cursor color palette contains 24 bits defining the color of each of the three displayable cursor colors, with each color component (Red, Green, Blue) defined by 8 bits of data.

In the operation of such typical cursor circuitry, when the cursor control logic determines that the cursor should be displayed, it reads the cursor SRAM to obtain the 2 bits defining the cursor pixel at the displayed location. The three 8-bit color components for the cursor pixel, corresponding to the value read, are obtained from the cursor palette and provided to the alternate inputs of the multiplexors. If the cursor pixel datum does not have a 00 value, then the multiplexors select the cursor color which is applied to three output DACs that drive the display color. If the cursor pixel datum has a 00 value, then the multiplexors are forced to select the primary pixel color which is applied to the output DACs. When the cursor control logic determines that the cursor should not be displayed, the multiplexors select the primary pixel color which is applied to the three DACs.

In an alternative known method, the pixel data corresponding to the cursor is converted to the logical inverse of one primary color component of the image, that is, one of the red, green or blue image data components, rather than a color defined in the cursor palette.

The following reference illustrates the state of the pertinent art.

U.S. Pat. No. 5,270,688 to Dawson, et al., discloses a method for generating a cursor which contrasts with the background image.

With a conventional cursor such as is known in the art, solid colors pixels are used to replace the pixels of the underlying display image. The solid colors of the cursor therefore obstruct the user's view of vital on-screen information exactly at the point of interest where the selection or picking or active drawing operation is taking place. In many cases this provides a confusing, uncomfortable, undesirable, or inconvenient aspect and feel to the user interface and may therefore reduce user acceptance and productivity. The prior art does not provide a method for the clear and unobstructed simultaneous viewing of both the cursor and the underlying graphical information.

Thus, it is desirable to provide a method for the clear and unobstructed viewing access to both the cursor and the underlying graphical information in an unambiguous manner. At the on-screen location of the cursor, the user should be able to distinguish both the cursor and the underlying graphical data.

SUMMARY OF THE INVENTION

An object of the present invention is to provide a method and apparatus for generating a semitransparent cursor.

Another object of the present invention is to provide a method and apparatus for generating a cursor which facilitates simultaneous viewing access to both the cursor and the underlying image information.

Yet another object of the present invention is to provide a method and apparatus for generating a cursor which allows reasonably unobstructed viewing of the underlying image.

Thus, according to the invention, a method and apparatus for producing a semitransparent cursor on a data processing display is disclosed.

BRIEF DESCRIPTION OF THE DRAWING

The FIGURE shows a block representation of a circuit for generating a semitransparent cursor.

DETAILED DESCRIPTION OF THE PREFERRED EMBODIMENTS

The present invention provides a method and apparatus for producing a semitransparent cursor for a video display permitting simultaneous viewing access to both the cursor and the underlying image information in an unambiguous manner to the viewer. At the on-screen location of the cursor, the viewer is able to simultaneously view and distinguish between the cursor and the underlying graphical data.

Only one color value can be displayed at any one pixel location of the display screen. At pixel locations where the cursor and underlying the graphical data interact, it is desirable to present color values that maintain the information content of the underlying image and also clearly present the information provided by the cursor. By providing cursor colors that allow the colors of the underlying graphical data to shine through, it is possible for the user to view both sources of information simultaneously. Because of its nature, such a cursor is described as "semitransparent".

Given the finite and fully utilized range of color values available at any one display pixel, the range of color values is shared between the colors of the graphical data and the defined colors of the cursor. It is important that the imposition of the cursor should not unduly change the color contrast of the underlying graphical data, thus it is preferred that any operation be applied equally to each primary color component of the graphical data. Nevertheless, the skilled artisan will appreciate that different operations may be performed on different colors while remaining within the scope and spirit of the invention. The shape of the cursor is then made visible by the modification of the intensity of the underlying graphical data and the injection of any predefined color data. The effect on the viewing user is that of a colored cursor through which the underlying graphical data can be clearly seen. It is as though the cursor consisted of a transparent multi-colored filter through which the underlying graphical data is being viewed.

In one embodiment, a semitransparent cursor is generated with an output color value for a pixel that is the unweighted, or alternatively, the weighted average of the colors of the graphical data pixel and the cursor pixel. Such a technique would generally be described as "blending", and provides a subtle intermixing of cursor and graphical data. While this is described as a digital mixing process, it will be appreciated that the invention may be adapted to an analog mixing process, which for example, may be a mixing process applied to an analog device drive signal.

In an alternate, preferred embodiment, the color values for the pixel of the underlying graphical data are halved by means of a logical shift right for pixels corresponding to the cursor. This leaves the most significant bit of the resultant values empty, that is, equal to 0. At the location of the most significant bit of each color value, a single bit is added depending on the desired color of the cursor. The injection of a single bit having a value of either 0 or 1 for each of the three color components allows for 8 different and visually distinct cursor colors to be added. The 8 apparent cursor colors are diagrammatically shown in Table 1.

TABLE 1

| COLOR COMPONENT | | | APPARENT COLOR |
|---|---|---|---|
| RED | GREEN | BLUE | of SPRITE/CURSOR |
| 0 | 0 | 0 | GRAY |
| 0 | 0 | 1 | BLUE |
| 0 | 1 | 0 | GREEN |
| 0 | 1 | 1 | CYAN |
| 1 | 0 | 0 | RED |
| 1 | 0 | 1 | MAGENTA |
| 1 | 1 | 0 | YELLOW |
| 1 | 1 | 1 | WHITE |

A method of generating a semitransparent cursor according to the above described preferred embodiment is illustrated by the following example, as diagrammatically shown in Table 2, where a magenta (101) cursor pixel is imposed on a pixel from the underlying graphical data. The resulting color values will give the appearance of the underlying graphical data viewed through a magenta cursor layer at the displayed pixel. While the embodiment is described in terms of a halving of the color values for the pixel of the underlying graphical data, it will be appreciate that other operations, such as quartering, may be performed in an alternative embodiment of the method.

TABLE 2

| RED | | | | | | | | GREEN | | | | | | | | BLUE | | | | | | | |
|---|---|---|---|---|---|---|---|---|---|---|---|---|---|---|---|---|---|---|---|---|---|---|---|
| R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| HALVE | | | | | | | | | | | | | | | | | | | | | | | |
| 0 | R7 | R6 | R5 | R4 | R3 | R2 | R1 | 0 | G7 | G6 | G5 | G4 | G3 | G2 | G1 | 0 | B7 | B6 | B5 | B4 | B3 | B2 | B1 |
| INJECT 101 | | | | | | | | | | | | | | | | | | | | | | | |
| 1 | R7 | R6 | R5 | R4 | R3 | R2 | R1 | 0 | G7 | G6 | G5 | G4 | G3 | G2 | G1 | 1 | B7 | B6 | B5 | B4 | B3 | B2 | B1 |

A circuit to generate a semitransparent cursor according to the above described preferred embodiment is shown in the FIGURE. Referring to the FIGURE, a 1 K byte SRAM (2) provides the storage to define a cursor in a square field 64 pixels wide by 64 lines high using 2 bits for each cursor pixel. The 2 bits per pixel allows the definition of 4 different types of cursor pixel, with the 00 value used to define a transparent cursor pixel. The other three values (01,10,11) are used to define the three different 3-bit translucent colors stored in the cursor color palette (4). When the cursor control logic (6) determines that the cursor should be displayed, it reads the cursor SRAM (2) to obtain the 2 bits defining the cursor pixel at the displayed location. The three 1-bit color components for the cursor pixel are obtained from the cursor palette (4) and provided to the most significant bit positions of the alternate inputs of the multiplexors (8). The least significant 7 bits of the alternate inputs of each of the multiplexors (8) are obtained from the most significant 7 bits of each color component of the primary pixel data. Therefore, at the alternate inputs of the multiplexors (8), a composite translucent color has been formed by injecting the 3-bit cursor color over the primary Pixel color that has been halved in intensity. At locations where the cursor is non-transparent, the multiplexors (8) select the composite translucent color which is applied to the three DACs that drive the display color. When the cursor Control logic (6) determines that the cursor should not be displayed, or if the cursor pixel has a 00 value, the multiplexors (8) select the primary Pixel color which is applied to the three DACs that drive the display color.

In another alternative preferred embodiment, the present invention generates a cursor that combines solid and semi-transparent colors. Each color in a full color cursor palette is assigned an attribute that determines whether the color is transparent, solid, or semitransparent. For example, a cursor palette will store four 24-bit colors each having corresponding attribute bits. When the cursor control logic determines that the cursor should be displayed, it reads the cursor SRAM to obtain the 2 bits defining the cursor pixel at the displayed location. The 2 bits obtained from the cursor SRAM are used to select one of the four colors and its associated attribute bits. The attribute bits will determine whether the cursor pixel is transparent, a solid color, or semitransparent. When the cursor pixel is transparent, the multiplexors select the primary pixel color. When the cursor pixel is of a solid color, the multiplexors select the fully defined cursor color. When the cursor pixel is of the semi-transparent type, the multiplexors select a composite translucent color that has been formed by injecting the most significant bit of each component of the cursor color over the primary pixel color that has been halved in intensity.

While the methods and apparatus disclosed herein have been described with respect to a icon cursor, such methods and apparatus are equally applicable to a cross-hair cursor or any other type of cursor.

Additionally, while the methods and apparatus disclosed herein have been described with respect to a palette DAC design having 8 bits per color, such methods and apparatus are equally adaptable to any other number of bits per color.

Yet additionally, while the methods and apparatus disclosed herein have been described with respect to a 2 bit per pixel (bpp) cursor resolution, such methods and apparatus are equally adaptable to any other valid level of resolution, including without limitation, 1, 4, and 8 bpp cursors.

Furthermore, while the methods disclosed herein have been described with respect to operations performed by a palette DAC, such methods are equally adaptable to being performed elsewhere within a data processing system, including without limitation, being performed in main memory. Similarly, the apparatus of the invention may be located within a palette DAC or elsewhere in a data processing system.

Upon a reading of the present disclosure, it will be apparent to the skilled artisan that other embodiments of the present invention beyond those embodiments specifically described herein may be made or practiced without departing from the spirit of the invention. Similarly, changes, lo combinations and modifications of the presently disclosed embodiments will also become apparent. The embodiments disclosed and the details thereof are intended to teach the practice of the invention and are intended to be illustrative and not limiting. Accordingly, such apparent but undisclosed embodiments, changes, combinations, and modifications are considered to be within the spirit and scope of the present invention as limited solely by the appended claims.

What is claimed is:

1. A method of producing data for displaying a semitransparent video screen cursor in which an underlying image remains visible where said cursor is displayed, comprising the steps of:

a) obtaining video pixel data corresponding to at least one of the red, green, and blue components of each pixel representing said underlying image;

b) halving, at least one time, the numerical value of each datum of said at least one component of said video pixel data;

c) injecting a cursor color value into the most significant bit of each said datum to obtain modified video pixel data by replacing said most significant bit with said cursor color value; and d) outputting said modified video pixel data.

2. The method of claim 1 wherein said modified video pixel data is output to a device in connection with a video display.

3. The method of claim 1 wherein said steps of obtaining, halving and injecting are performed with respect to each of said red, green, and blue color components of said underlying image data.

4. The method of claim 3 wherein said modified video pixel data is output to a device in connection with a video display.

5. A circuit adapted to produce data for display of a semitransparent cursor and an underlying image on a video screen such that said underlying image remains visible where said cursor is displayed, comprising means for generating semitransparent cursor data by halving, at least one time, the numerical value of at least one datum corresponding to one of the red, green and blue components representing said underlying image, and replacing a most significant bit of said halved datum with a cursor color value, and means for a) selecting said semitransparent cursor data for display at cursor locations of a video screen, and for b) selecting said unmodified numerical value of said at least one datum for display elsewhere on said video screen such that upon producing a display with said data said underlying image remains visible where said cursor is displayed.

6. A circuit adapted to produce data for display of a semitransparent cursor on a video screen such that an underlying image remains visible where said cursor is displayed, comprising at least one multiplexor coupled to receive a cursor color value and a multiple bit color component datum corresponding to one of the red, green and blue components representing an underlying image, said multiplexor adapted to selectively output semitransparent cursor data by transferring said cursor color value to a most significant bit position of said cursor data and by halving said datum and transferring said halved datum to less significant bit positions of said cursor data.

7. A computer system having a circuit adapted to produce data for display of a semitransparent cursor on a video screen such that said underlying image remains visible where said cursor is displayed, said circuit comprising at least one multiplexer coupled to receive a cursor color value and a multiple bit color component datum corresponding to one of the red, green and blue components representing an underlying image, said multiplexor adapted to selectively output semitransparent cursor data by transferring said cursor color value to a most significant bit position of said cursor data and by halving said datum and transferring said halved datum to less significant bit positions of said cursor data.

* * * * *